US011280598B2

(12) United States Patent
Kralj

(10) Patent No.: US 11,280,598 B2
(45) Date of Patent: Mar. 22, 2022

(54) COLOR MARKER PROJECTILE

(71) Applicant: AREX PROIZVODNJA ORODIJ, NAPRAV IN STORITVE D.O.O. ŠENTJERNEJ, Šentjernej (SI)

(72) Inventor: Ivan Kralj, Brusnice (SI)

(73) Assignee: AREX PROIZVODNJA ORODIJ, NAPRAV IN STORITVE D.O.O. ŠENTJERNEJ, Šentjernej (SI)

( * ) Notice: Subject to any disclaimer, the term of this patent is extended or adjusted under 35 U.S.C. 154(b) by 0 days.

(21) Appl. No.: 16/906,883

(22) Filed: Jun. 19, 2020

(65) Prior Publication Data

US 2020/0408494 A1 Dec. 31, 2020

(30) Foreign Application Priority Data

Jun. 28, 2019 (SI) ..... 201900124

(51) Int. Cl.
*F42B 12/40* (2006.01)

(52) U.S. Cl.
CPC ..... *F42B 12/40* (2013.01)

(58) Field of Classification Search
CPC ..... F42B 12/40; F42B 12/46
See application file for complete search history.

(56) References Cited

U.S. PATENT DOCUMENTS 3,865,038 A * 2/1975 Barr ..... F42B 12/50 102/502
4,128,059 A * 12/1978 Black ..... F42B 12/40 102/513
5,035,183 A * 7/1991 Luxton ..... F42B 12/40 102/502
6,990,905 B1 * 1/2006 Manole ..... F42B 12/40 102/513
7,331,293 B2 * 2/2008 Saxby ..... F42B 12/40 102/502
8,286,557 B2 * 10/2012 Endicott ..... F42B 12/40 102/513
8,485,102 B2 * 7/2013 Carlson ..... F42B 5/045 102/513
9,157,715 B1 * 10/2015 Lafortune ..... F42B 14/02
9,261,338 B2 * 2/2016 Saxby ..... F42B 12/40
9,494,397 B2 * 11/2016 Carlson ..... F42B 12/40
9,513,094 B2 * 12/2016 Dierks ..... F42B 12/40
9,958,242 B2 * 5/2018 Sullivan ..... F42B 12/40
10,697,745 B2 * 6/2020 Cooper ..... F42B 12/367
2006/0011090 A1 * 1/2006 Vasel ..... F42B 5/16 102/512
2010/0282118 A1 * 11/2010 Ladyjensky ..... F42B 12/40 102/513
2021/0318106 A1 * 10/2021 Bruno ..... F42B 10/46

* cited by examiner

*Primary Examiner* — Joshua T Semick
(74) *Attorney, Agent, or Firm* — Maschoff Brennan

(57) ABSTRACT

A color marker projectile, which is intended as a non-lethal projectile to mark a hit with color, is located in the projectile itself and is poured over the target on impact. The projectile is launched from a conversion kit (new barrel and bolt) of a real weapon. The color marker projectile includes a front part, a rear part, an inserted element and a color filler. The front part is formed as a semicircular cylindrical part with vertical ribs. The inserted element is positioned to complete the concluded cylindrical part of the front part. The color filler and the inserted element are positioned on the inside of the front part. The color filler is located at the contact point between the front part and the rear part.

8 Claims, 3 Drawing Sheets

COLOR MARKER PROJECTILE

The subject matter of this invention is a color marker projectile, intended as a non-lethal projectile to mark a hit with color which is located in the projectile itself and is poured over the target on impact. The projectile is launched from a conversion kit (new barrel and bolt) of a real weapon. The invention falls within Class F 42B 12/40 of the International Patent Classification.

The technical issue successfully resolved by the submitted invention is a construction solution of a color marker projectile, i.e. intended marking of a hit with color, by using improved ballistic properties and more accurate hits, which can be used with real weapons using the inserted conversion kit.

The patent document FR2323981 describes the marked projectile, made of thin casing made out of expanded polystyrene and created in two separate parts with contained pigment dust. The projectile is inserted into a metal cup which is retained with a string attached to the bottom of the insert. The projectile is placed on a plastic ring in a metal cup and is retained with a wax card. The exterior of the metal cup fits snugly into the interior portion of the insert, whereby the insert is created long enough to direct the trajectory of the cup. This creation is complicated to manufacture and does not allow for simple handling. This is why hitting the target with such a projectile is hard and imprecise.

Figure 1:
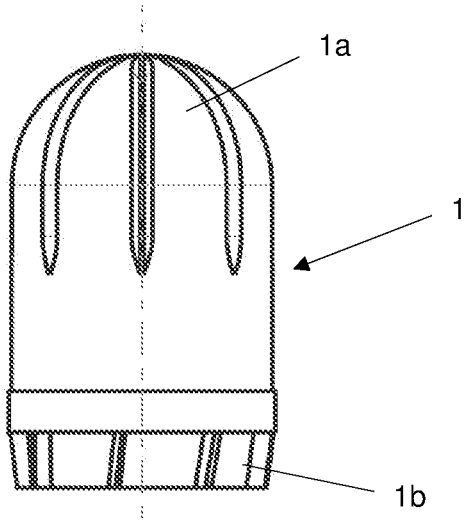
Figure 2:
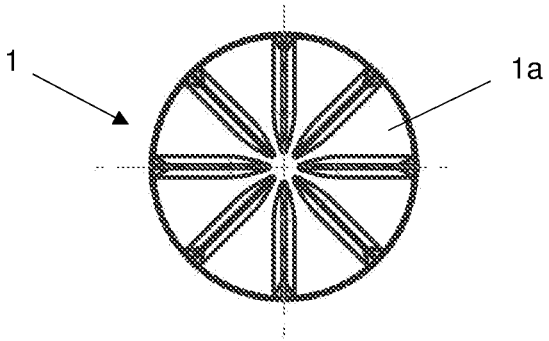
Figure 3:
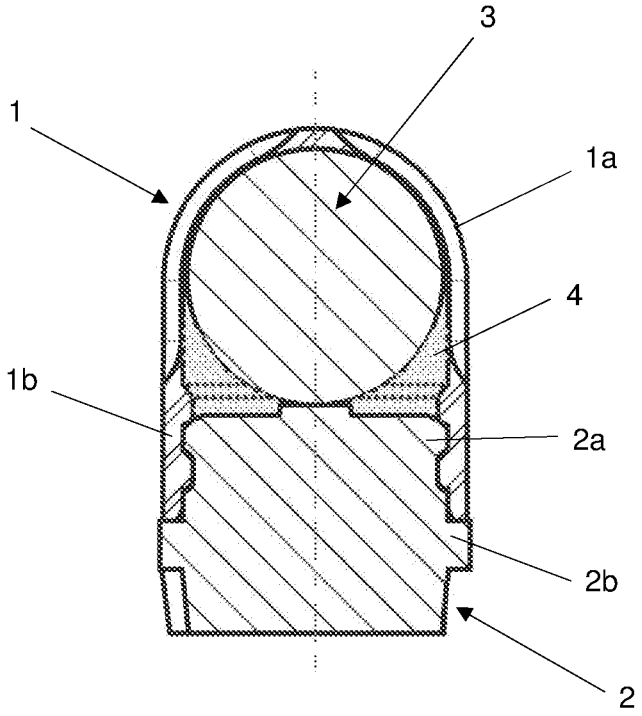
Figure 4:
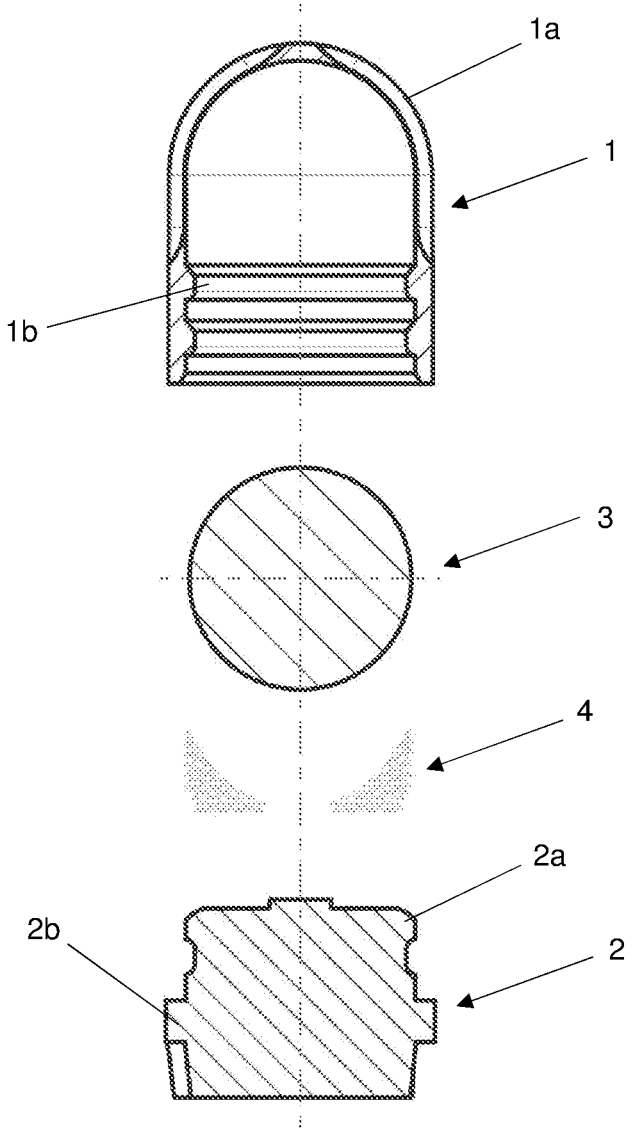

We will provide a detailed explanation of the invention based on an implementation example and the following pictures:

FIG. 1 color marker projectile according to the invention, side view;

FIG. 2 color marker projectile according to the invention, top view;

FIG. 3 color marker projectile according to the invention, side view, cross-section;

FIG. 4 color marker projectile according to the invention, side view, cross-section, disassembled state;

The color marker projectile according to the invention is made of a front part 1, a rear part 2, an inserted element 3 and a color filler 4.

The front part 1 is formed as a semicircular cylindrical part made out of high-density polyethylene ((PEND), whereby the concluded cylindrical part has formed vertical ribs 1*a* which are retained by a thin connecting layer in the semicircular portion when the projectile is undischarged. The front part is formed based on caliber 7.65 mm for a 9 mm cartridge.

The color filler 4 and the element 3 in the shape of a geometric solid figure (a ball or a square, a cylinder, etc.) is also located inside the front part 1. The element 3 is located so as to complete the concluded cylindrical part of the front part 1, while the color filler 4 is located at the contact point between the front part 1 and the back part 2.

The inserted element is formed so as to enable an increased spill of color filler 4 during contact with the target. This is important because it enables a large paint stain to be visible on the target. The inserted element 3 plays a key role in external and target ballistics. Its shape makes it possible for the color filler 4, the front part 1 and the inserted element 3 to spin at the same speed, which enables a stable flight of the entire projectile (including the rear part 2). Without the inserted element 3, the target ballistics is more than ten times less efficient and, above all, uncontrolled.

The color filler 4 has adhesive properties in order to better adhere to the target as it spills.

The element 3 is made out of thermoplastic polyurethane (TPU)—soft rubber.

The lower part of the cylindrically-shaped completion of the front part 1 consists of a groove 1*b* which is locked with a ring 2*a* of the rear part 2, which makes it tight and prevents the color filler 4 to leak out.

The rear part 2 also consists of a sealing ring 2*b* for sealing gases between the barrel and the projectile. The diameter of the front part 1 is dimensioned according to the dimensions of the ring 2*b*, i.e. 7.65 mm.

The rear portion 2 also consists of wings 2*c* which enable additional stabilisation of the flight.

The color marker projectile according to the invention is set to a specifically shaped shell casing which expands (is extended) during activation. This enables AUTO (self-loading) functioning through the use of the conversion kit.

The invention claimed is:

1. A color marker projectile comprising:

a front part formed as a domed cylinder with ribs forming a dome of the front part;

a rear part which is partially encapsulated by the front part;

an inserted element positioned within and engaging the dome of the front part; and a color filler, wherein: the color filler and the inserted element are positioned on the inside of the hollow portion of the front part, and the color filler occupies a cavity formed by the inserted element, the rear part, and the front part.

2. The color marker projectile of claim 1, wherein: a lower, cylindrically-shaped completion of the front part includes a groove locked with a ring of the rear part, and the rear part also has a sealing ring for sealing gases between a barrel and the projectile.

3. The color marker projectile of claim 1, wherein: the ribs are connected at an apex of the dome of the front part when the projectile is undischarged.

4. The color marker projectile of claim 3, wherein: a lower, cylindrically-shaped completion of the front part includes a groove locked with a ring of the rear part, and the rear part also has a sealing ring for sealing gases between a barrel and the projectile.

5. The color marker projectile of claim 1, wherein: the inserted element has a shape of a geometric solid figure.

6. The color marker projectile of claim 5, wherein: a lower, cylindrically-shaped completion of the front part includes a groove locked with a ring of the rear part, and the rear part also has a sealing ring for sealing gases between a barrel and the projectile.

7. The color marker projectile of claim 5, wherein the geometric solid figure is one of a ball, a cuboid, and a cylinder.

8. The color marker projectile of claim 1, wherein the inserted element is made from a thermoplastic polyurethane material.

* * * * *